United States Patent [19]

Benz

[11] 4,456,325

[45] Jun. 26, 1984

[54] ELECTRICAL CONNECTION DEVICE

[75] Inventor: Reinhard Benz, Basel, Switzerland

[73] Assignee: Sotax AG, Basel, Switzerland

[21] Appl. No.: 543,783

[22] Filed: Oct. 20, 1983

Related U.S. Application Data

[63] Continuation of Ser. No. 241,742, Mar. 9, 1981, abandoned.

[30] Foreign Application Priority Data

Mar. 13, 1980 [CH] Switzerland ..... 1969/80

[51] Int. Cl.[3] ..... H01R 4/28

[52] U.S. Cl. ..... 339/256 RT; 339/252 R; 339/258 A; 339/262 R

[58] Field of Search ..... 339/252 R, 256 R, 256 RT, 339/258 R, 258 A, 258 C, 258 RR, 258 P, 259 R, 262 R

[56] References Cited

U.S. PATENT DOCUMENTS

| | | | |
|---|---|---|---|
| 3,034,093 | 5/1962 | Blain | 339/258 R |
| 3,638,166 | 1/1972 | Steipe | 339/61 M |
| 3,956,607 | 5/1976 | Van Wijnandsbergen | 339/262 R |

FOREIGN PATENT DOCUMENTS

| | | | |
|---|---|---|---|
| 682598 | 10/1939 | Fed. Rep. of Germany . | |
| 1131776 | 6/1962 | Fed. Rep. of Germany . | |
| 1944009 | 3/1970 | Fed. Rep. of Germany | 339/262 R |
| 2632851 | 4/1977 | Fed. Rep. of Germany | 339/256 R |
| 2633892 | 5/1977 | Fed. Rep. of Germany | 339/256 R |
| 1263085 | 4/1961 | France | 339/258 RR |
| 2284203 | 4/1976 | France . | |
| 665122 | 4/1964 | Italy | 339/256 R |
| 7700585 | 7/1977 | Netherlands | 339/256 R |
| 172844 | 2/1935 | Switzerland . | |
| 955160 | 4/1964 | United Kingdom . | |
| 1225309 | 3/1971 | United Kingdom . | |
| 1248075 | 9/1971 | United Kingdom . | |
| 1394527 | 5/1975 | United Kingdom . | |

OTHER PUBLICATIONS

Technische Rundschau; No. 36; Aug. 26, 1975; pp. 33–35, "Das MC-Kontaktlamellenprinzip".

*Primary Examiner*—John McQuade
*Assistant Examiner*—Gary F. Paumen
*Attorney, Agent, or Firm*—Michael J. Striker

[57] ABSTRACT

There is disclosed an electrical connection device for producing an electrically conductive connection between two contact bodies, the device comprising resilient means of a material having good spring properties and a plurality of plate-shaped conductor members of a material with good electrical conductivity. The resilient means may consist of a central strip and a plurality of tongues arranged in pairs and protruding from both sides of the strip. Each conductor member is provided at one of its wide sides, namely its base surface, with a cross-shaped recess receiving part of the resilient element. The resilient element and conductor members are connected together at the free ends of the tongues, the conductor members being longer and wider in plan than the tongues. The conductor members therefore cover a relatively large part of the contact area covered by the device as a whole. The resilient element and the recesses are so arranged that only a small part of the base surface of each conductor member bears against the resilient element. As a result, a high degree of resilience is present in the device notwithstanding the large area covered by the conductor members.

12 Claims, 30 Drawing Figures

Fig.1
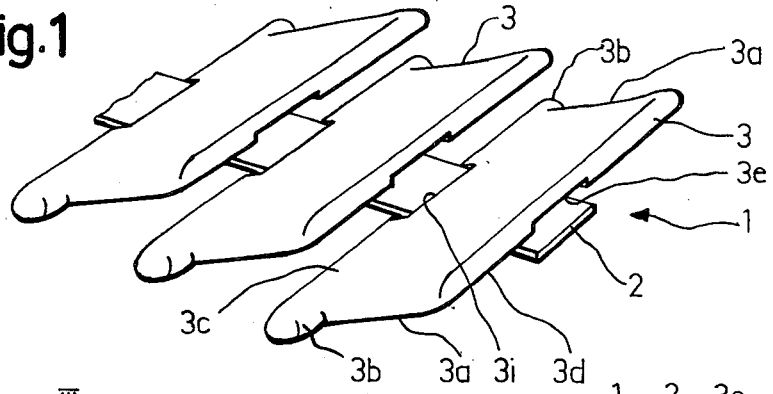
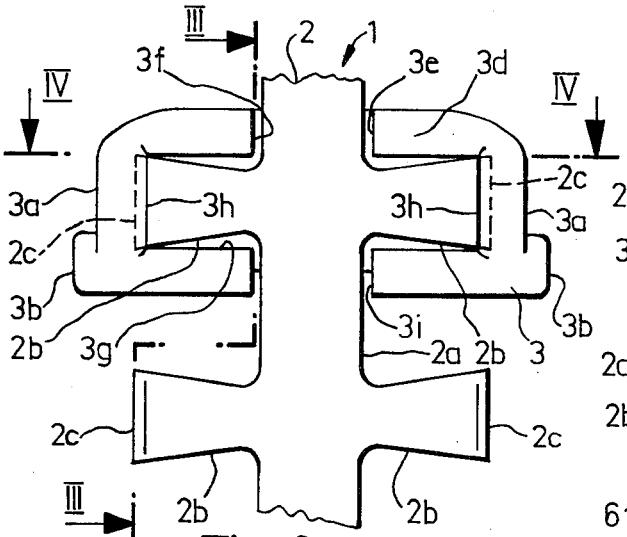
Fig.2
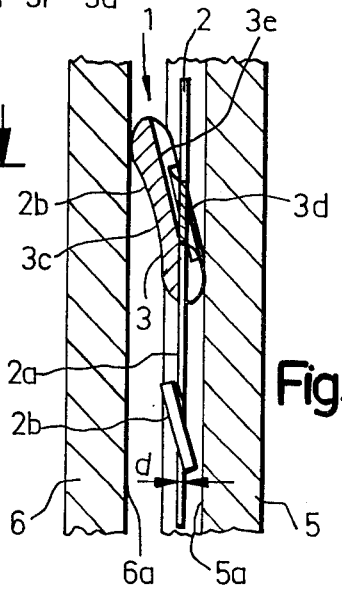
Fig.3
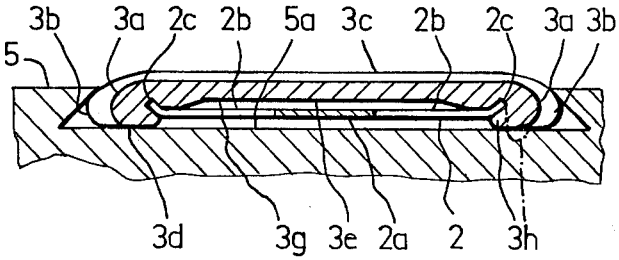
Fig.4
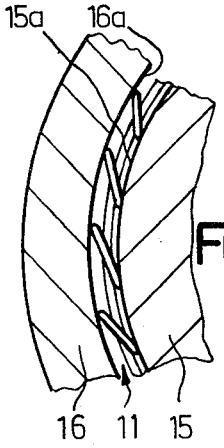
Fig.5

Fig.12
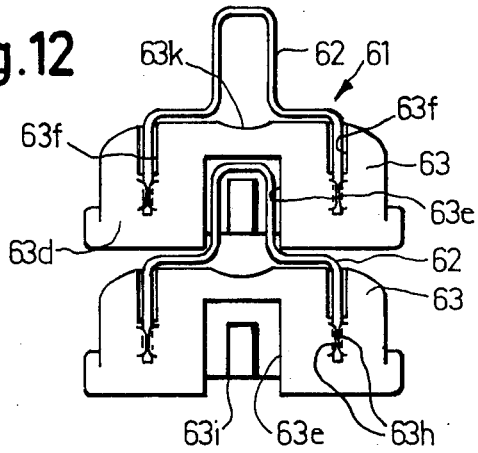
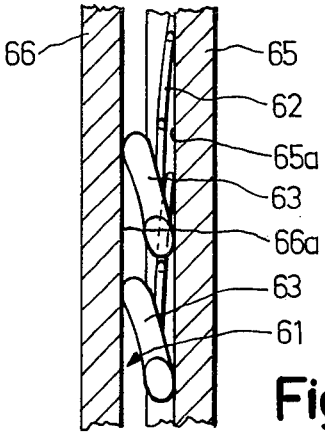
Fig.13
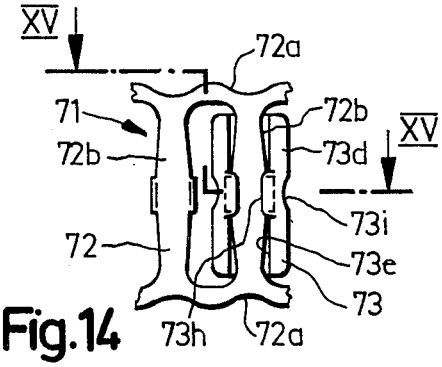
Fig.14
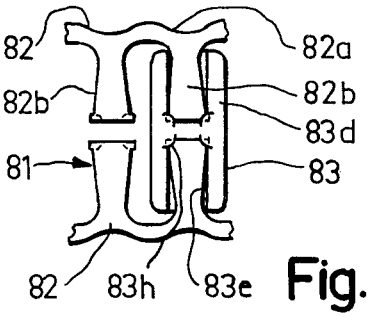
Fig.16
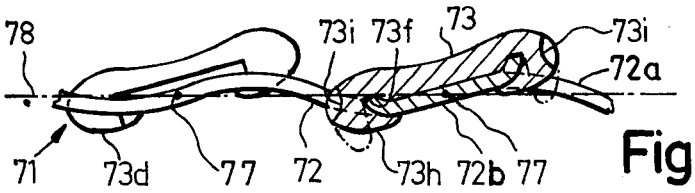
Fig.15
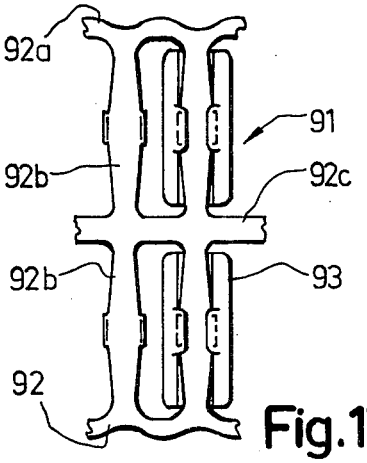
Fig.17
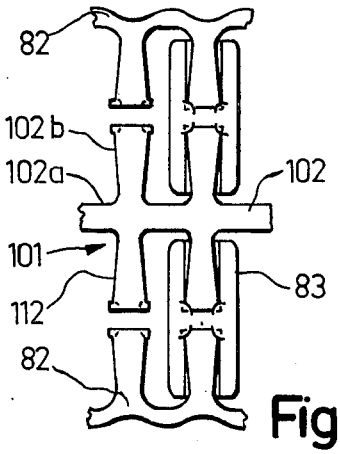
Fig.18

Fig. 24
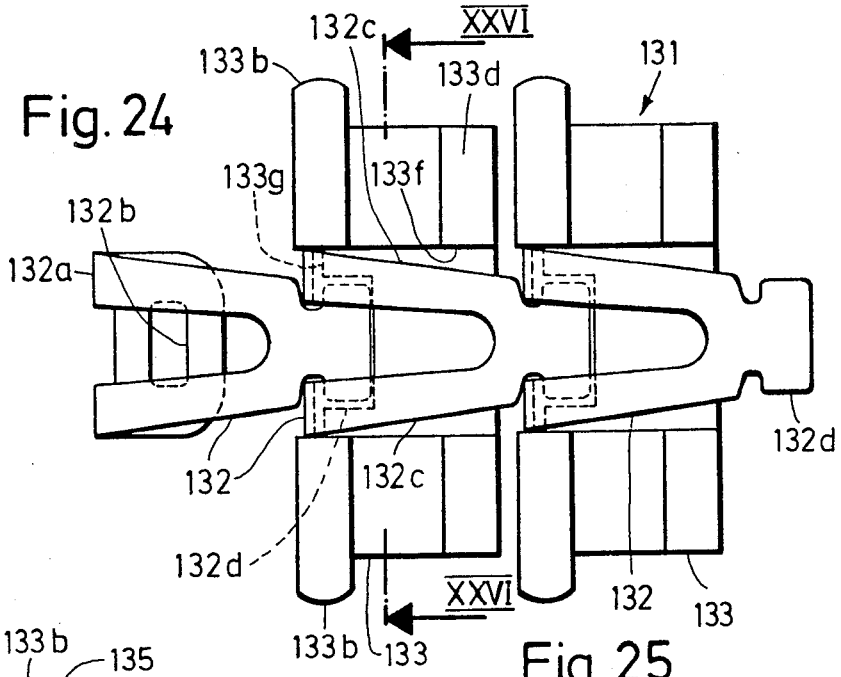
Fig. 25
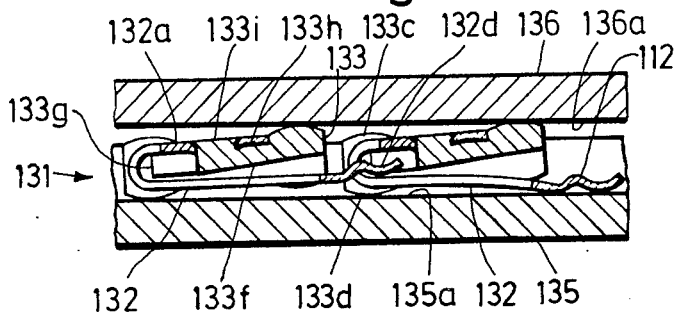
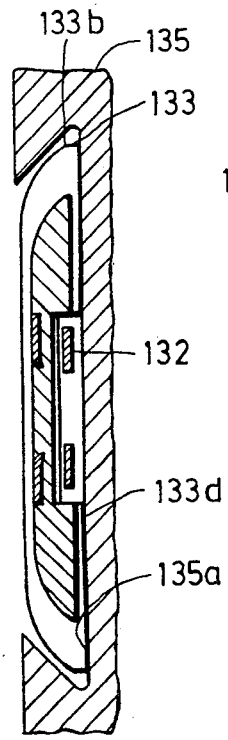
Fig. 26
Fig. 27
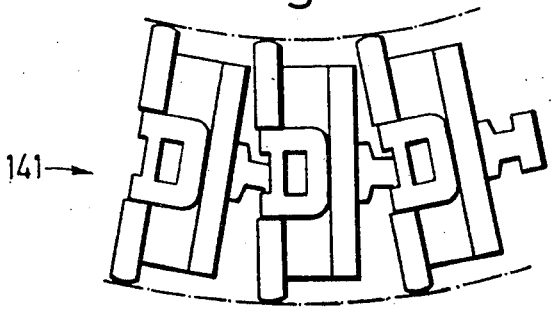

ELECTRICAL CONNECTION DEVICE

This application is a continuation of application Ser. No. 241,742, filed Mar. 9, 1981, now abandoned.

BACKGROUND OF THE INVENTION

The present invention relates to an electrical connection device for contact with and production of an electrical connection between two contact bodies.

Electrical connection or contact devices of that kind are used for, in particular electrical connection in which relatively large currents, for example more than 50 amps, are to be transmitted.

In an electrical plug connection the two contact bodies are constituted by a socket sleeve and a plug pin plugged into the sleeve. The contact device can be fastened either in the sleeve or on the pin. Such contact devices are also used in current distributor systems for the connection of current rails. The contact devices are then arranged between the interconnected rail sections. In addition, the contact devices can be used in switching devices, in which case they are fastened to the fixed or movable contact body of such a switching device.

A contact device, which has a row of resilient laminae, is disclosed in the specification of published French patent application No. 2 339 259. The laminae are connected together at their ends either by sheet metal strips contiguous therewith or by separate strips into which the ends of the laminae are hooked. The laminae, which consist of a material having good spring properties, are provided with a coating of another material with good electrical conductivity. The coatings can be formed by, for example, metal strip which encompass the longitudinal edges of the laminae. They can, however, be soldered, welded or glued in place. In all cases, substantially the entire area of the metal strips at the sides of the laminae bears against the laminae.

Through the combination of two different materials as in the afore-described prior art contact device, it is endeavoured to achieve optimum spring properties and optimum electrical conduction properties. In order that the spring effect of the laminae is not unduly impaired, only a relatively small zone in the centre of each laminae is coated with the electrically highly conductive, but essentially non-resilient or only poorly resilient, material. Accordingly, only a relatively small proportion of the entire plan area of the contact device can be utilized for current conduction. If a large current is to be transmitted, the contact device must therefore have relatively large dimensions in plan. In that case, it must also be taken into account that the lengths of inherently resilient laminae with non-resilient coatings cannot be proportionally enlarged, as otherwise, due to bending of the laminae, only a few contact places would be present between the coating and the contact bodies.

OBJECTS OF THE INVENTION

The present invention has as its principal object the provision of an electrical connection contact device which, with the smallest possible dimensions, makes possible a large current transmission, has a good spring effect, and maintains these properties at high temperatures.

A subsidiary object of the invention is the provision of a device of the kind mentioned which can be manufactured economically.

Other objects and advantages of the present invention will be apparent from the following description.

SUMMARY OF THE INVENTION

According to the present invention there is provided an electrical connection device for contact with and production of an electrically conductive connection between two juxtaposed contact bodies, the device comprising a plurality of conductor members of electrically conductive material arranged in at least one row, and resilient means of a different material connecting the conductor members together. Each of the conductor members is arranged in such a manner that, in plan projection thereof from a plane in which it has the greatest area, it protrudes outwardly of the resilient means and is in constant contact with the resilient means over an area which is at most 75 percent of the entire area of the member in the plan projection.

With regard to the reference in the description and claims to the term "plan projection", the conductor members are in general plate-shaped, i.e. their lengths and widths measured along one plane are greater than their thickness, the width of each member being at least two to three times greater than its thickness. The conductor members are substantially planar or, at most, slightly bowed. The members therefore span a plane extending approximately parallel to their wide sides. The projection of the conductor member onto this plane gives the plan of the member. The reference to plan projection area of the conductor member is thus to be understood as the area bounded by the plan outline, i.e. by the narrow sides of the member. The plan is such that the plan projection area is the greatest possible projection area of the member that can result from a projection onto one plane. As each conductor member is, in general, approximately planar, apart from recesses for the resilient means, the areas of both its wide sides, namely its top surface and its base surface, are to a good approximation each equal in size to the plan projection area. That area which is in constant contact with the resilient means is represented by the projection of that conductor member area portion which, in any setting of the resilient means, bears against the resilient means without any gap being present. In the region of the resilient element contacted by that area portion of each conductor member, the resilient means cannot deform with respect to the conductor member. Thereagainst, the resilient means can resiliently deform with respect to each conductor member in those regions in which it does not contact, or constantly contact, the members.

In a device embodying the invention, a relatively large proportion of the entire area covered in plan by the contact device can be covered by the conductor members. As a result, a high current passage is possible by comparison with the overall size of that area.

The question of whether or not the resilient means is electrically conductive is of no consequence. Equally, any capability of the conductor members to resiliently deform is of secondary importance.

It is thus possible to manufacture the resilient means from a material which has a greater resilient deformability than the material of the conductor members, or in other words, the material of the resilient means shall be capable of a greater degree of deformation than the conductor members without permanent deformation arising. Conversely, the conductor members can manufactured from a material which has a greater specific electrical conductivity than the material of the resilient means.

BRIEF DESCRIPTION OF THE DRAWINGS

Embodiments of the present invention will now be more particularly described by way of example only, with reference to the accompanying drawings, in which:

FIG. 1 is a perspective view of a section of a contact device according to a first embodiment of the invention, FIG. 2 is an inverted plan view of the contact device section of FIG. 1, wherein, however, tongue members of the device have not been twisted and a conductor member has not been fitted to one of the pairs of tongue members, FIG. 3 is a section along the line III—III of FIG. 2, and showing two contact bodies conductively connected by the contact device, FIG. 4 is a section along the line IV—IV of FIG. 2, showing the device contacting one contact body and showing a tongue member of the device in the untwisted state, FIG. 5 is a section corresponding to FIG. 3, but wherein the contact device is arranged between contact bodies with cylindrical contact surfaces, FIG. 12 is an inverted plan view of a section of a contact device according to a sixth embodiment of the invention, adjacent conductor members of the device being connected together by a respective bracket, FIG. 13 is a side view of the contact device section of FIG. 12, the device being inserted between two contact bodies shown in section, FIG. 14 is an inverted plan view of a section of a contact device according to a seventh embodiment of the invention, FIG. 15 is a section, to an enlarged scale, along the line XV—XV of FIG. 14, FIG. 16 is an inverted plan view of a section of a contact device according to an eigthth embodiment of the invention, FIG. 17 is an inverted plan view of a section of a contact device according to a ninth embodiment of the invention, FIG. 18 is an inverted plan view of a section of a contact device according to a tenth embodiment of the invention, FIG. 24 is an inverted plan view of a section of a contact device according to a twelfth embodiment of the invention, FIG. 25 is a longitudinal section of the contact device of FIG. 24, the device being arranged between two contact bodies, FIG. 26 is a cross-section along the line XXVI—XXVI of FIG. 24, only one of the contact bodies being shown and a conductor member of the device being illustrated in a position parallel to that body, FIG. 27 is a plan view of the contact device section of FIG. 24, the conductor device being bent into a curved form.

DESCRIPTION OF THE PREFERRED EMBODIMENTS

Figure 6:
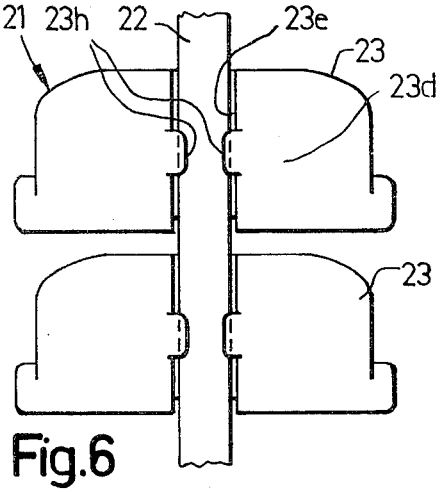
FIG. 6 is a plan view of a section of contact device according to a second embodiment of the invention, the device comprising a resilient element in the form of a corrugated, tongueless strip.

Referring now to the drawings, in FIGS. 1 to 4 there is shown a contact device 1 which comprises a resilient element 2 and a row of conductor members 3. Each of the members 3 is plate-shaped, i.e. its outline dimensions evident in FIG. 2 are at least three times greater than its thickness measured at right angles thereto. The conductor members are substantially planar. The resilient element 2 comprises a centre strip 2*a*, which extends continuously over the entire length of the contact device and the width of which is a multiple of its thickness d. The centre strip 2*a* is provided, for each conductor member 3, with a respective pair of laterally protruding, twisted tongues 2*b*, which laterally protrude at both longitudinal edges of the centre strip 2*a* and widen towards their free ends. The plate-shaped conductor members 3 have a substantially rectangular shape in plan view onto their wide sides. They are, however, provided at each of their edges 3*a* extending parallelly to the longitudinal direction of the centre strip 2*a*, and at the same edge extending transversely to this longitudinal direction, with a respective dog 3*b*, which is rounded in cross-section and protrudes laterally beyond the associated edge 3*a*. The longer sides of each conductor member extend transversely to the longitudinal direction of the resilient element 2 and to the direction of the row of conductor members.

The somewhat concave surface of each conductor member 3, disposed at the top in FIGS. 1 to 4, is designated in the following as the top surface 3c. The oppositely disposed surface is designated in the following as the base surface 3d. Each member 3 is provided in the region of its base surface with a cross-shaped recess 3e formed by two mutually crossing grooves 3f and 3g. The groove 3f extending in the longitudinal direction of the centre strip 2a is somewhat wider than the centre strip and extends over the entire base surface 3d. In the region between the dogs 3b, the depth of the groove 3f increases towards its end so that its end comes out in the top surface 3c and so as to produce a recess 3i. The groove 3g, by contrast to the groove 3f, does not extend over the entire base surface, so that a ridge of material is left between its distal ends and respectively adjacent edges 3a. The groove 3g has approximately the same width as the free ends 2c of the tongues 2b. As is evident from FIGS. 2 and 4, the free ends 2c of the tongues 2b are bent up slightly, bear against the bottom of the groove 3g and are held by upset projections 3h. In FIG. 4, the shape assumed by one of the projections 3h before upsetting thereof is indicated by chain-dotted lines. The conductor members 3 are thus fastened to the resilient element 2 at the free ends 2c of the tongues 2b.

It is shown in FIG. 3 how the contact device 1 can be arranged between two metallic contact base bodies 5 and 6, which are to be electrically connected together and which have planar, mutually facing contact surfaces 5a and 6a. As a consequence of the twisting of the tongues 2b, the substantially planar conductor members 3 are inclined with respect to the contact surfaces 5a and 6a, so that one edge, extending transversely to the longitudinal direction of the centre strip 2a, of each conductor member 3 bears against the contact body 5 and the oppositely disposed edge against the contact body 6, the resilient element 2 generating the contact force.

The contact surface 5a is formed by the bottom of a dovetail groove, the walls of which partially encompass and pivotably hold the dogs 3b, as is shown in FIG. 4. The two contact bodies 5 and 6 may comprise, for example, a flat plug pin and a part of the plug socket, which is to be electrically connected thereto and into which the pin is plugged. The two contact bodies can, however, be formed by the fixed and movable contact parts of a switching device, or by two current rails which are screwed together in the region of the contact device 1.

As is evident from FIG. 4, the tongue sections disposed between both the ends 2c and also the section of the centre strip 2a between the two tongues do not bear against the associated conductor member 3 or, stated more accurately, against the bottom of the groove 3g. As can be inferred from FIG. 3, the centre strip 2a bears against the conductor member 3 only over a relatively short distance at the part of the groove 3f disposed between the dogs 3b. Accordingly, of that section of the resilient element 2 which, in the plan view of FIG. 2, is disposed within the outline of the base surface 3d, i.e. within the plan of the conductor member 3, only a small part constantly bears firmly against the conductor member 3. Present between the remaining part of the aforesaid section of the resilient element 2 and the member 3 is a space, which accommodates resilient deformation of the resilient element. In addition, each conductor member 3 in plan protrudes at all sides beyond the tongues 2b by a distance equal to at least twice and, for example, about five to ten times, the material thickness d of the resilient element 2. Thus, in a perpendicular view onto the plane spanned by the conductor member 3, i.e. in the plan view illustrated in FIG. 2, the resilient element 2 covers a part of the base surface 3d which at most amounts to 75%, and even less than 50%, of the entire base surface 3d. Accordingly, each conductor member 3 at most bears against the resilient element in a region of its base surface 3d which, in the plan projection, is smaller than 75%, or even smaller than 50%, of the projection of the entire base surface. Since, as already mentioned, a free space is present between different sections of the resilient element 2 and each conductor member 3 within the plan of the member, the member actually bears against the resilient element only by a part of the base surface portion covered by the resilient element, particularly when the resilient element 3 is not stressed. With the resilient element unstressed, i.e. when the contact device is not arranged between contact bodies, less than 20% of the base surface 3d of the conductor member in the plan projection bears against the resilient element.

In the contact device 1, the conductor members 3 thus in plan extend over almost the entire area covered by the contact device. In addition, each conductor member 3 in plan transversely to the longitudinal direction of the tow of members has a greater dimension than the resilient element 2 and protrudes at both sides beyond the resilient element 2 perpendicularly to the longitudinal direction. This is particularly so in the case of the rounded edge zones of the member, these edge zones extending transversely to the aforesaid longitudinal direction and bearing against the contact surfaces 5a and 6a. From this results a current capacity which is large in comparison with the plan dimensions of the contact device. Since the resilient element 2 can still freely flex over relatively large distances, the contact device 1 also has good spring properties.

It is to be noted that the centre strip 2a can be corrugated in its longitudinal direction, in which case the tongues 2b would then be arranged at wave flanks of the corrugation. As a result, the spring effect may be increased.

FIG. 5 shows an application in which a contact device 11, which has a substantially similar construction to the contact device 1, is arranged between two circularly cylindrical contact surfaces 15a and 16a of two contact bodies 15 and 16, respectively. The contact body 15 can possibly be formed by the pin of a plug and the contact body 16 by a socket sleeve into which the pin is plugged.

Figure 7:
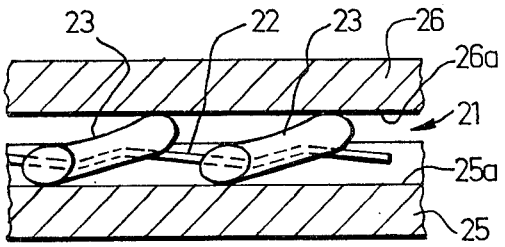
FIG. 7 is a side view of the contact device section of FIG. 6, the device being shown arranged between two sectioned contact bodies.

FIGS. 6 and 7 show a contact device 21 which comprises a resilient element 22, which consists of a smooth, tongueless strip corrugated in its longitudinal direction, and conductor members 23. The members 23 are similar in outline shape to the conductor members 3 and each have a recess 23e, which is formed by a groove extending in the longitudinal direction of the resilient element 22. The resilient element 22 extends through the recess 23e. Each member 23 protrudes at both longitudinal edges of the resilient element 22 laterally outwardly thereof and is fastened to the resilient element 22 by upset projections 23h, in particular at inclined wave flanks of the corrugated form of the element 22. The recesses 23e are somewhat deeper in their regions disposed outside the region of the projections 23h than at the projections, so that each member 23 bears against the resilient element 22 only in the region of the projections 23h, and the resilient element can flex freely over relatively long sections of its length. The contact device 21 can be arranged between planar contact surfaces 25*a* and 26*a* of two contact bodies 25 and 26, respectively. It is, however, equally possible to arrange the device 21 also between two contact bodies 15 and 16 with curved contact surfaces.

Figure 8:
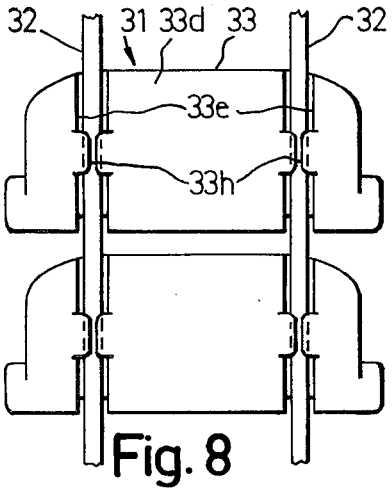
FIG. 8 is a plan view of a section of a contact device according to a third embodiment of the invention.

The contact device 31 shown in FIG. 8 comprises two strip-shaped resilient element 32, which extend parallel to each other, are curved in their longitudinal direction, and are formed by wires or bands which are narrow in comparison with the width of associated conductor members 33. Each conductor member 33 is provided in the region of its base surface 33*d* with two groove-shaped recesses 33*e* for the two resilient elements 32. The conductor members 33 are fastened to the resilient elements 32 by means of upset projections 33*h* in the centre of the recesses 33*e*. The conductor members thus protrude appreciably beyond both longitudinal sides of the two resilient elements. The recesses 33*e* are such that the base surface 33*d* of each conductor member 33 bears against the resilient elements only in the region of the projections 33*h*. The part of the base surface 33*d* bearing against both resilient elements is accordingly only a small part of the entire base surface, as in the case of the contact devices 1 and 21.

Figure 9:
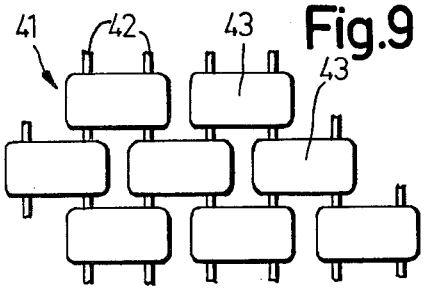
FIG. 9 is a plan view of a section of a contact device according to a fourth embodiment of the invention.

The contact device 41 shown in FIG. 9 comprises several resilient elements 42 extending parallel to each other and several rows of conductor members 43. Conductor members belonging alternately to two different rows are fastened to the inner resilient elements 42. The resilient elements 42 are identical with the resilient elements 32, and the conductor members 43 are constructed similarly to the members 33 apart from the fact that the laterally protruding dogs are omitted. The conductor members of the two outermost rows can, however, be provided with laterally protruding dogs. The contact device 41 is particularly suited for electrically connecting contact bodies with wide contact surfaces.

Figure 10:
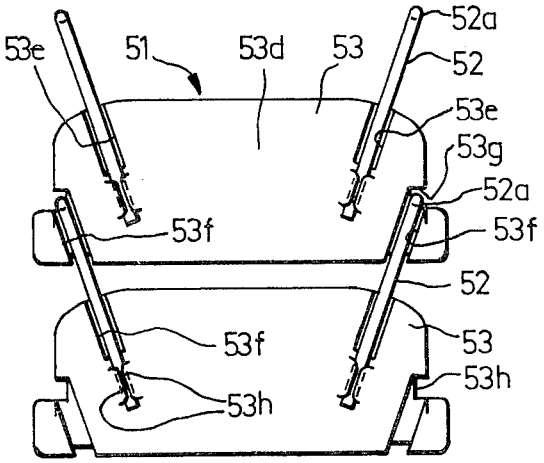
FIG. 10 is a plan view of a section of a contact device according to a fifth embodiment of the invention, wherein adjacent conductor members of the device are connected together by a respective pair of resilient elements.
Figure 11:
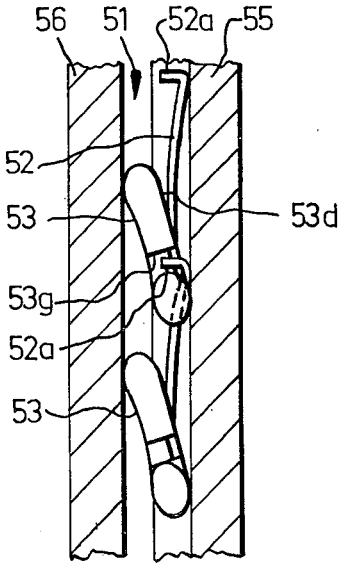
FIG. 11 is a side view of the contact device section of FIG. 10, the device being arranged between two contact bodies.
Figure 19:
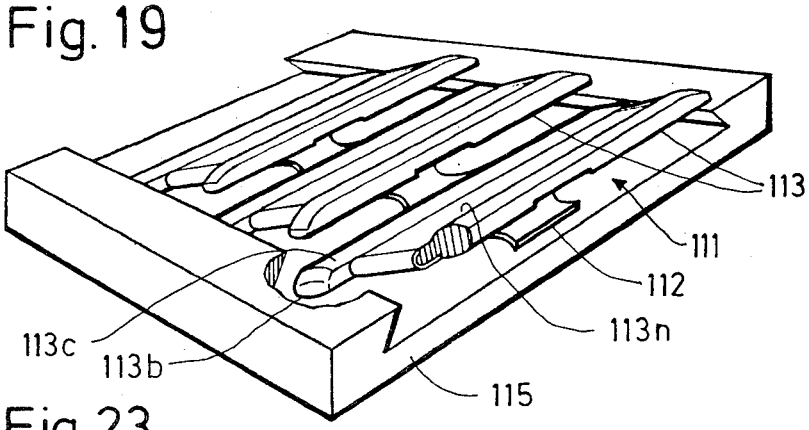
FIG. 19 is a perspective view of a contact device according to an eleventh embodiment of the invention, the device being mounted on a contact body.

The contact device 51 illustrated in FIGS. 10 and 11 comprises a row of conductor members 53. The members 63 are connected with each other in pairs in each case by a pair of wire-like resilient elements 52, one end 52*a* of each element being bent away in the manner of a hook, Each of the conductor members 53 is provided in the region of its base surface 53*d* with two groove-shaped recesses 53*e* and two groove-shaped recesses 53*f*, these recesses 53*e* and 53*f* forming an acute angle with the longitudinal direction of the row of conductor members. In addition, an incision 53*g* is provided at one end of each recess 53*f* and receives the hook-like end 52*a* of a respective one of the resilient elements 52. the other ends of the resilient elements are fastened to the conductor members 53 by upset projections 53*h* at the ends of the recesses 53*f*. The recesses 53*e* are such that the sections of the resilient elements covered by them bear against each conductor member only at the projections 53*h*. The contact device 51, which is especially suitable for conductor members with relatively large dimensions and high current loadings, can be arranged between two contact bodies 55 and 56, which are similar in construction to the contact bodies 5 and 6, respectively, apart from possibly different dimensions.

The contact device 61 illustrated in FIGS. 12 and 13 is also particularly suitable for conductor members with relatively large dimensions. Successive conductor members 63 are connected with each other in pairs in each case by a stirrup-shaped resilient element 62. Each conductor member 63 is provided at its side with the base surface 63*d*, with a recess 63*e* in the form of a U-shaped groove, the limbs of the groove opening out at an edge of the conductor member extending transversely to the longitudinal direction of the row of members. Also present are two recesses 63*f* formed by straight grooves. The two ends of a stirrup-shaped resilient element 62 are fastened to one of the conductor members 63 by means of upset projections 63*h*, which are disposed at the inner ends of the recesses 63*f*. The central U-shaped part of the resilient element 62 lies in the recess 63*e* of a neighbouring conductor member 63. The members 63 in plan have a substantially similar outline shape to the member 3. They are, however, provided with incisions 63*i*and 63*k*, in the centres of, respectively, the two edges extending transversely to the longitudinal direction of the row of conductor members. These incisions 63*i* and 63*k* subdivide the substantially straight transverse edges into two halves and result in the advantage, particularly in the case of wide conductor members, that the members 63 bear uniformly against the contact surfaces 65*a* and 66*a* of two contact bodies 65 and 66, respectively, at both sides of the incisions.

It is noted that an additional incision could be provided opposite the incision 3*i* in each of the conductor members 3. Equally, it would be possible in the case of the conductor members of the other described embodiments to provide incisions corresponding to the incisions 63*i* and 63*k*.

The contact device 71 illustrated in FIGS. 14 and 15 comprises a resilient element 72 and a row of plate-shaped conductor members 73. The resilient element 72 is provided with two strips 72*a*, which extend in the longitudinal direction of the row and which are connected with each other by webs 72*b* extending transversely thereto. As is evident from FIG. 15, the strips 72*a* are continuously corrugated in longitudinal section. Each web 72*b* is disposed at a wave flank of the corrugations, i.e. between a wave valley and a following wave ridge. The webs 72*b* have approximately the same inclination as the strip sections with which they are contiguous, and they are inclined over their entire length with respect to a plane 78, which extends through the geometric axes 77 of the central sections of two successive webs 72*b*.

Each conductor member 73 is provided with a groove-shaped recess 73*e* in the region of its base surface 73*d*. The central web section bears against the conductor member 73 in the recess 73*e*, while its laterally protruding, bent edges engage into depressions 73*f*, and is fastened by upset projections 73*h* of the member 73. The projections 73*h* before the upsetting have the position indicated in chain-dotted lines in FIG. 15. The two web sections disposed between the projections 63*h* and the strips 72*a* are separated from the conductor member 73 by a space. The edges of the conductor member 73 extending parallel to the webs 72*b* are each provided with a centrally disposed rounded incision 73*i*.

The strip sections disposed between two successive webs 72*b* are bent outwardly so that the resilient element 72 is wider between the webs 72*b* than at these webs. The outer longitudinal edges of the resilient element form, over their entire length, a continuously sinusoidal line. The inner edges of the strip sections between the webs 72*b* are bent in the same direction as the sections of the outer longitudinal edges disposed in the same region, so that the strip sections between the webs 72b have approximately the same width over their entire length.

The described formation of the strips results in particularly good spring properties, as well as a high resistance to fatigue fracture. In addition, the outwardly protruding sinusoidal sections of the strips 72a can be easily pushed into dovetal-shaped grooves of a contact body, so that the contact device can be securely retained.

The contact device 81 illustrated in FIG. 16 comprises two resilient elements 82, each of which is provided with a corrugated connecting strip 82a and a row of tongues 82b. Each conductor member 83 is provided at its base surface 83d with two groove-shaped recesses 83e, into which protrude two mutually opposite tongues 82b of the two resilient elements 82. The conductor members are fastened to the free ends of the tongues 82b by means of upset projections 83h.

The contact device 91 shown in FIG. 17 comprises a resilient element 92 with two rows of webs 92b, which have the same construction as the webs 72b of the resilient element 72. The connecting strips 92a connecting the two rows of webs with each other at the outside have the same construction as the connection strips 72a. Between the two rows of webs, the webs 92b are contiguous with a central connecting web 92c . Conductor members 93 are fastened to the webs 92b in like manner as the conductor members 73 to the webs 72b. The transverse edges of the conductor members extending transversely to the connecting strips can be continuously straight or be provided with central rounded incisions.

FIG. 18 shows a contact device 101 with three resilient elements, namely two outer and one central. The two outer resilient elements 82 are identical with those of the contact device of FIG. 16. The central resilient element 102 has a central strip 102a and tongues 102b protruding therefrom at both sides, and is thus constructed in similar manner to the resilient element 2, but is additionally corrugated in its longitudinal direction. The conductor members 83 of the contact device 101 are identical with those of the contact device 81 and are fastened in analogous manner to the tongues of the resilient elements.

The contact device 111 illustrated in FIGS. 19 to 22 comprises a resilient element 112 with a centre strip 112a and tongues 112b protruding laterally in pairs, and a row of conductor members 113. The contact device 111 is constructed in similar manner to the contact device 1. Each conductor member 113 has a generally rectangular outline, the longer rectangular side extending at right angles to the longitudinal direction of the resilient element. Each member 113 has a top surface 113c and a base surface 113d. Present in the latter is a recess 113e, which is formed by two crossing grooves 113f and 113g. The contact device 111 differs from the contact device 1 in that the grooves 113g extend up to the side edges of the respective conductor member. The side edges are provided with incisions 113m, which continue the grooves 113g and which in turn are connected with each other by a groove 113n in the top surface 113c. The contact device 111 also differs from the contact device 1 in that the free ends 112c of the tongue 112b are each bent into a hook shape, grip around a respective incision 113m, and project into a respective groove 113n. As is evident from FIGS. 19, 20 and 22, the conductor members 113 extend beyond the tongues 112b, transversely to the longitudinal direction of the resilient element 112, at both sides of the tongues. Although the tongues 112b grip around the conductor members, the members have a greater maximum dimension transversely to the longitudinal direction of the row than the resilient element 112.

The depth of the groove 113f extending in the longitudinal direction of the resilient element 112 increases towards its end between the dogs 113b, as is the case in the contact device 1. Where the depressed part of the groove 113f protrudes into the region of the groove 113g, the latter is provided with depressions. Each of the depressions is formed by an inclined triangular surface which at the base line of the triangle passes into the undepressed part of the groove 113g.

The contact device 111 can be arranged between two contact bodies 115 and 116 with planar, mutually parallel contact surfaces 115a and 116a, respectively. The contact surface 115a is formed by the bottom of a dovetail groove, the walls of which partly encompass and pivotably hold the dogs 113b. The tongues 112b are twisted in such a manner that they endeavour to incline the conductor body 113 with respect to the centre strip 112a extending approximately parallel to the contact surfaces 115a and 116a and to press it against both the contact surfaces, as is evident from FIG. 21.

Figure 20:
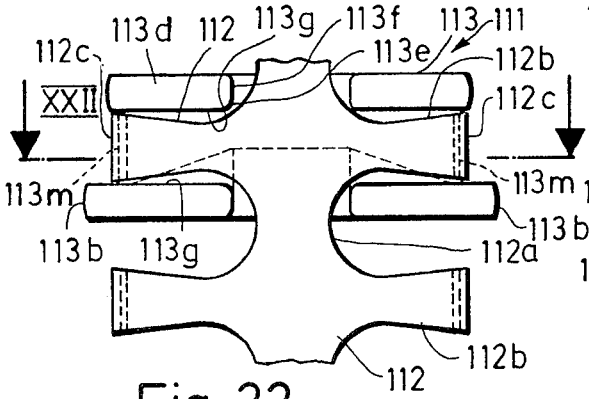
FIG. 20 is an inverted plan view of a section of the contact device of FIG. 19, wherein a conductor member is not yet fitted to one pair of tongues of the device and those tongues are shown in an untwisted state.
Figure 22:
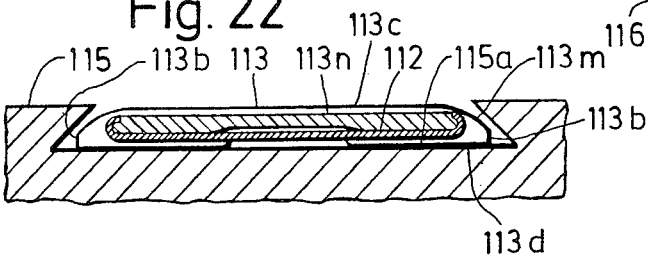
FIG. 22 is a cross-section of the contact device along the line XXII—XXII of FIG. 20, the device being shown mounted in one contact member body and a tongue of the device being illustrated in untwisted state.

In the projection of the conductor member 113 illustrated in FIG. 20, the part of the conductor member projection area overlapped by the projection of the resilient element 112 amounts to less than 75%, and even somewhat less than 50%, of the entire projection surface of the conductor member. Due to the twisting of the tongues 112b, the resilient element 112 bears against the conductor member only at the hook-shaped tongue ends and at a few other places of small area. The part of the resilient element 112 constantly bearing against the conductor member 113 is thus in the plan projection smaller than 50% and even smaller than 20% of the entire plan projection surface of the conductor member so that this is very well held in resilient manner.

Since the conductor member 113 at those places at which it touches the contact surfaces 115a and 116a, i.e. at its edges extending transversely to the longitudinal direction of the row, protrudes beyond the resilient element at both sides thereof transversely to the longitudinal direction, the contact device 11 has a high current loading capacity by comparison with its plan dimensions.

The conductor members 113 are, during manufacture, bent transversely to the longitudinal direction of the row so that they can be laid in between the hook-shaped ends of a pair of tongues. Thereafter, the conductor members are pressed flat by a press so that they are held by the tongues.

Figure 23:
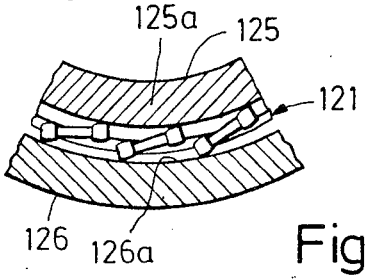
FIG. 23 is an elevation of the contact device of FIGS. 19 and 20 arranged between two contact bodies with cylindrical contact surfaces.
Figure 21:
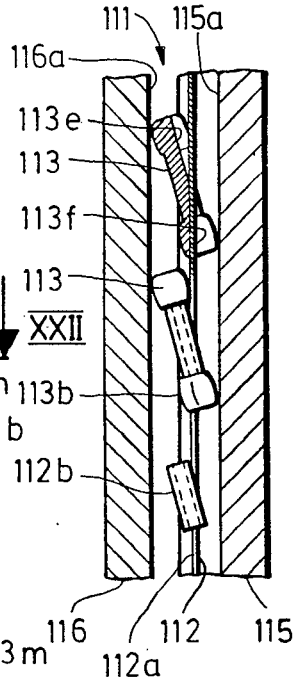
FIG. 21 is a longitudinal section of the contact device of FIGS. 19 and 20, wherein the device is arranged between two contact bodies and wherein one conductor member of the device is illustrated in section, another conductor member in end view, and a tongue of the device is shown without a conductor member.

The contact device 121 illustrated in FIG. 23 is substantially similar in construction to the contact device 111, but is arranged between two contact bodies 125 and 126 with co-axially curved contact surfaces 125a and 126a.

The contact device 131 illustrated in FIGS. 24 to 26, like the contact device 61 of FIGS. 12 and 13, comprises a separate resilient element 132 for each conductor member 133. Each member 133 is provided in the region of its base surface 133d with a groove 133f extending in the longitudinal direction of the tow of conductor member. This groove is contiguous with a stepped incision 133g present between the laterally protruding dogs 133b. A recess 133h, which starts at the incision 133g and from which a dog 133*i* protrudes, is also present in the top surface 133*c*.

Each resilient element 132 is provided at its wider end with a hook 132*a*, which encompasses the conductor member in the interior of the incision 133*g*. One part of the hook 132*a* has an opening 132*b* complementary with the dog 133*i* and is rigidly held in the recess 133*h* by the dog 133*i*, which is upset during connection of the conductor member with the resilient element. The part of the element 132 disposed in the groove 133*f* is formed by two limbs 132*c*, which are initially separated from each other by a wide gap, converge in the direction away from the hook 132*a* and finally unite like a tongue 132*d*, which is provided in each side edge thereof with a respective recess and is corrugated in the longitudinal direction of the row of conductor members.

The contact device 132 thus consists of a number of units each comprising a conductor member 133 and a resilient element 132 fastened thereto by means of the hook 132*a*. The tongue 132*d*, which protrudes beyond the associated conductor member at the side remote from the hook 132*a*, is hooked between the limbs 132*c* of the following resilient element, whereby the successive units are movably connected one with the other to form the row.

The contact device 131 is arranged between the planar, mutually parallel contact surfaces 135*a* and 136*a* of two contact bodies 135 and 136, respectively. The contact body 135 has a dovetail groove, the side walls of which pivotably hold the dogs 113*b*. The resilient elements 132 are biassed in such a manner that they incline the conductor members in the longitudinal direction of the row and press against the contact surfaces 135*a* and 136*a*, as is illustrated in FIG. 25.

The resilient elements 132 in the settings normally assumed by them bear against the associated conductor members 133 only by that part of the hook 132*a* which contains the opening 132*b*. A substantial part of each resilient element can thus spring freely, so that good spring properties result. In addition, a high current loading capacity is also present.

The contact device 141 illustrated in FIG. 27 is composed of units which are of identical construction to the units of the contact device 131. The conductor members are held in a contact body, of which only the path of a dovetail groove, indicated in chain-dotted lines, is represented. The dovetail groove is curved along the plane spanned by its base, which serves as a contact surface, so that the conductor members thus form not a straight but a curved row. This can, of course, be closed into a circle so that it becomes endless.

Figure 28:
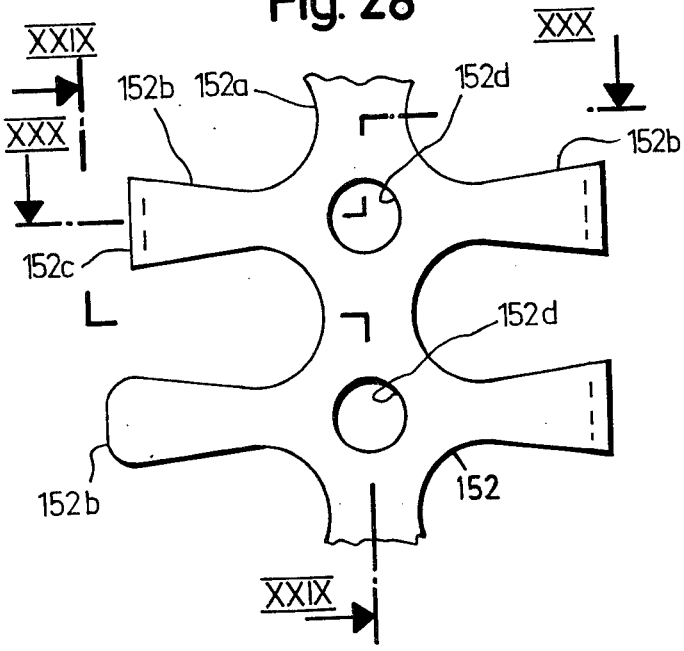
FIG. 28 is a plan view of a section of a resilient element in a contact device according to a thirteenth embodiment of the invention.
Figure 29:
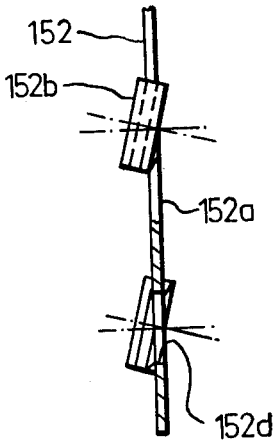
FIG. 29 is a cross-section of the resilient element on the line XXIX—XXIX of FIG. 28.
Figure 30:
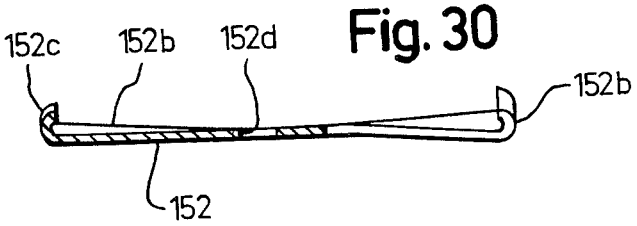
FIG. 30 is a sectional view of the resilient element on the line XXX—XXX of FIG. 29.

In FIGS. 28 to 30 there is shown a resilient element 152 of further contact device, the resilient element comprising a central strip 152*a* with pairs of laterally projecting tongues 152*b*. The free ends 152*c* of the tongues are bent to be hook-shaped, the tongue end at the lower left in FIG. 28 being shown in unbent state. In general, the tongues 152*b* are also shown in FIG. 28 in untwisted state, whereas they are illustrated in FIGS. 29 and 30 in the twisted form that they have in the completed contact device. The resilient element 152 is provided in the centre of each cross, which is formed by the central strip 152*a* and each pair of tongues connected therewith, with a hole 152*d* of, for example, circular shape.

The resilient element 152 is, apart from the holes 152*d*, of essentially the same construction as the spring element 112 of FIGS. 19 to 22 and can serve in placeof this for holding the conductor members 113. By means of the holes 152*d* the spring properties of the resilient element 152 can, by contrast to those of the resilient element 112, be changed and with respect to certain requirements, are improved. The resilient element 152 is especially suitable for, for example, construction of a contact device which is bent, as in the manner of the contact device 121 of FIG. 23, in the longitudinal direction of the central strip 152*a* along curved contact surfaces of contact bodies. The holes 152*d* enable a contact device equipped with the resilient element 152 to be bent with a relatively small radius of curvature without kinking zones arising in the resilient element.

It will also be noted that holes corresponding to the holes 152*d* could be provided in the resilient element 2 of FIGS. 1 to 4 as well as in the resilient elements 22, 72, 82, 92 and 102 of FIGS. 6 and 14 to 18.

The resilient elements of the different contact devices as hereinbefore described and illustrated in the figures consist of a material different from that of the conductor members. The materials are so selected that the resilient elements have optimum mechanical properties and particularly the greatest possible resilient deformability. In that case, the capacity for resilient twisting and flexing above all should be high and the elastic properties should be maintained up to high temperatures. The material of the conductor members can, however, have a substantially smaller elastic deformability. On the other hand, the specific electrical conductivity thereof should be as high as possible and expediently higher than that of the resilient element. The conductor members should preferably also have a high heat resistance and corrosion resistance so that they can be heated to at least the same temperatures as the resilient elements. This selection of the materials makes it possible to manufacture contact devices with a very high current loading capacity with respect to the overall plan area of the contact device.

The resilient elements can be manufactured from, for example, a nickel beryllium alloy which contains approximately 2% beryllium. This material is usable continuously at temperatures to 350° C. without substantial impairment of its elastic properties. During brief peak leadings, even temperatures up to 450° C. are permissible. The resilient elements can, however be manufactured from spring steel, possibly with a galvanic coating. In addition, copper-beryllium alloys or other materials with good elastic properties could be used.

The conductor members could consist of copper with a silvered surface. It is, however, possible to manufacture conductor bodies so that the central part consists of copper and the edge sections, bearing against the contact bodies, consist of silver. Of course, the conductor members can also be manufactured from other metals or alloys. The conductor members should, however, above all have a high electrical conductivity and be provided, at least at their edges where they bear against the contact bodies, with a surface which allows a good current transfer and which is corrosion resistant up to high temperatures according to the requirements.

In all the contact devices illustrated in the different figures, the resilient elements in plan overlap less than 75%, in particular at most 50%, of the conductor members. In addition, in the case of all of the described resilient elements, only a part of the portions thereof covered in plan by the conductor members actually bears firmly and continuously against the conductor members, as was explained in detail with reference to the contact device 1. Accordingly, a high current loading capacity is possible, by comparison with the total contact surface area covered, in all embodiments and good spring properties can also be achieved.

It will be readily apparent that the conductor members can be secured to the resilient elements in other ways apart from upset projections or other deformations, for example by rivetting or welding. In addition, most of the described embodiments of contact devices can be constructed analogously to the contact device 141 illustrated in FIG. 27, so that the row or rows of conductor members form a closed circle which extends along a planar contact surface.

I claim:

1. An electrical connection device for production of an electrically conductive connection between two juxtaposed contact bodies, the device comprising at least two rigid conductor members of electrically conductive material arranged in at least one row and each defining two opposite edges which extend transverse to the longitudinal direction of said row; resilient means of a different material connecting said conductor members together and acting upon the same side of said at least two conductor members; each of said conductor members being so arranged that, in plan projection thereof from a plane in which it has the greatest area, it protrudes outwardly of said resilient means and is in constant contact therewith over an area which is at most 75 percent of the entire area of the member in said projection; said resilient means including corrugated elements attached to each conductor member so that one of said transverse edges of the latter bears against one contact body and the opposite transverse edge bears against the other contact body whereby said corrugated elements generate a contact force.

2. A device according to claim 1, wherein each of said conductor members is substantially rectangular in plan and is provided at each of its edges extending substantially parallel to the longitudinal direction of said row with an outwardly projecting dog which extends transversely to said longitudinal direction for slidable engagement with said contact body.

3. A device according to claim 1, wherein each of said conductor members is in constant contact with said resilient means over an area which is at most 50 percent of the entire area of said other side.

4. A device according to claim 1, wherein each of said conductor members includes an area which covers, in the plan projection of the member, a portion of said resilient means but without making firm contact with said portion.

5. A device according to claim 1, wherein said resilient means overlaps at most 50 percent of said area.

6. A device as defined in claim 1, wherein said contact body is formed with a groove defining side walls, and wherein each of said conductor members comprises two bearing portions, each conductor member in the row being so arranged that said two bearing portions thereof protrude outwardly of the resilient means, at two opposite sides thereof, transversely to the longitudinal direction of the row to slidably engage said side walls of said groove.

7. A device as defined in claim 1, wherein each of said conductor members is formed with lateral recesses, and the free ends of each pair of tongue elements being connected to an assigned member in said lateral recesses.

8. An electrical connection device for production of an electrically conductive connection between two juxtaposed contact bodies, the device comprising a plurality of conductor members of electrically conductive material arranged in at least one row; resilient means of a different material connecting said conductor members together; each of said conductor members being so arranged that, in plan projection thereof from a plane in which it has the greatest area, it protrudes outwardly of said resilient means and is in constant contact therewith over an area which is at most 75 percent of the entire area of the member in said projection; said resilient means including a strip portion extending in the longitudinal direction of said row and a plurality of pairs of tongue elements laterally projecting from said strip portion; each of said pairs of tongue elements being attached to a respective one of said conductor members; and each of the tongue elements of each pair extending from a respective one of two opposite sides of said strip portion and being twisted about the longitudinal axis thereof.

9. An electrical connection device for production of an electrically conductive connection between two juxtaposed contact bodies, the device comprising a plurality of conductor members of electrically conductive material arranged in at least one row; resilient means of a different material connecting said conductor members together; each of said conductor members being so arranged that, in plan projection thereof from a plane in which it has the greatest area, it protrudes outwardly of said resilient means and is in constant contact therewith over an area which is at most 75 percent of the entire area of the member in said projection; said resilient means including an elongate resilient element which extends continuously along the entire length of said row and is corrugated in said length direction; and said conductor members being secured to said elongate resilient element at inclined sections of the corrugated form thereof.

10. An electrical connection device for production of an electrically conductive connection between two juxtaposed contact bodies, the device comprising a plurality of conductor members of electrically conductive material arranged in at least one row; resilient means of a different material connecting said conductor members together; each of said conductor members being so arranged that, in plan projection thereof from a plane in which it has the greatest area, it protrudes outwardly of said resilient means and is in constant contact therewith over an area which is at most 75 percent of the entire area of the member in said projection; said resilient means including a strip portion extending in the longitudinal direction of said row and a plurality of pairs of tongue elements laterally projecting from said strip portion, each of said pairs of tongue elements being attached to a respective one of said conductor members, and each of the tongue elements of each pair extending from a respective one of two opposite sides of said strip portion, the tongue elements of each pair being attached to the respective conductor member at the free ends of the tongue elements, and portions of said tongue elements and of the strip portion between said free ends being spaced from said conductor member; and wherein each of said tongue elements is twisted about the longitudinal axis thereof.

11. An electrical connection device for production of an electrically conductive connection between two juxtaposed contact bodies, the device comprising a plurality of conductor members of electrically conductive material arranged in at least one row; resilient means of a different material connecting said conductor members together; each of said conductor members being so arranged that, in plan projection thereof from a plane in which it has the greatest area, it protrudes outwardly of said resilient means and is in constant contact therewith over an area which is at most 75 percent of the entire area of the member in said projection; said resilient means including a strip portion extending in the longitudinal direction of said row and a plurality of pairs of tongue elements laterally projecting from said strip portion, each of said pairs of tongue elements being attached to a respective one of said conductor members, and each of the tongue elements of each pair extending from a respective one of two opposite sides of said strip portion; said other side of respective conductor members being formed with a recess for accommodating the adjoining part of said resilient means, and said recess having a cross-shaped configuration corresponding to the outline of the combination of said strip portion and said pair of tongue elements.

12. An electrical connection device for production of an electrically conductive connection between two juxtaposed contact bodies, the device comprising a plurality of conductor members of electrically conductive material arranged in at least one row; resilient means of a different material connecting said conductor members together; each of said conductor members being so arranged that, in plan projection thereof from a plane in which it has the greatest area, it protrudes outwardly of said resilient means and is in constant contact therewith over an area which is at most 75 percent of the entire area of the member in said projection; said resilient means including a strip portion extending in the longitudinal direction of said row and a plurality of pairs of tongue elements laterally projecting from said strip portion, each of said pairs of tongue elements being attached to a respective one of said conductor members, and each of the tongue elements of each pair extending from a respective one of two opposite sides of said strip portion; each of said conductor members being formed with lateral recesses, and the free ends of each pair of tongue elements being connected to the assigned conductor member in said lateral recesses.

* * * * *